United States Patent [19]

Calzolari

[11] 4,105,373

[45] Aug. 8, 1978

[54] FLUID DISTRIBUTOR DEVICE FOR CONTROLLING AN APPARATUS FOR PUMPING WET CONCRETE AND THE LIKE

[75] Inventor: Sergio Calzolari, Rome, Italy

[73] Assignee: Fogt Industriemaschinenvertretung A.G., Chur, Switzerland

[21] Appl. No.: 744,326

[22] Filed: Nov. 23, 1976

Related U.S. Application Data

[63] Continuation-in-part of Ser. No. 523,017, Nov. 12, 1974, Pat. No. 3,994,627.

[30] Foreign Application Priority Data

Nov. 24, 1975 [IT] Italy ..... 52362 A/75

[51] Int. Cl.[2] ..... F04B 9/10; F04B 35/02; F04B 15/02

[52] U.S. Cl. ..... 417/317; 417/344; 417/507; 417/900

[58] Field of Search ..... 417/317, 344, 507, 900

[56] References Cited

U.S. PATENT DOCUMENTS

| | | | |
|---|---|---|---|
| Re. 26,820 | 3/1970 | Bennet | 417/317 |
| 3,327,641 | 6/1967 | Klosterman | 417/317 X |
| 3,667,869 | 6/1972 | Schlecht | 417/900 X |
| 3,994,627 | 11/1976 | Calzolari | 417/317 |

FOREIGN PATENT DOCUMENTS

| | | | |
|---|---|---|---|
| 2,326,997 | 12/1974 | Fed. Rep. of Germany | 417/317 |

*Primary Examiner*—Carlton R. Croyle
*Assistant Examiner*—R. E. Gluck
*Attorney, Agent, or Firm*—Wigman & Cohen

[57] ABSTRACT

A concrete pumping unit comprising a pair of parallel piston pumps, alternately placed in communication with a concrete supply conduit and with a concrete delivery pipe, through a single baffle blade valve and respectively driven by coaxial fluid pressure piston cylinders is disclosed. The cylinders are interlocked with each other by a pipe which places in communication the chambers of said fluid pessure cylinders, opposite to the chambers in which the pressurized fluid is supplied and discharged through orifices near the ends of said cylinders. A hydraulic circuit is provided for placing a fluid supply pump, in communication with the fluid pressure piston cylinder performing the suction phase, while the orifice of the other fluid pressure piston cylinder is placed in communication through another circuit including, a four-way changeover electro-valve and an actuator distributor device with a discharge reservoir. The said actuator-distributor device comprises two hydraulic pistons and cylinders, operating in phase opposition, the piston rods of which are linked to the ends of a rocking bar, the pivot pin of which is integral with the spindle of the baffle blade valve. The hydraulic piston cylinders have closed ends and are each provided near each of its ends with an orifice. First orifices, positioned near one of the two ends of said cylinders are interconnected by a pipe, while second orifices which are arranged near the other ends are respectively connected by a respective pipe to the four-way changeover electrovalve. The electrovalve is connected to a fluid pump and to a pipe to return the fluid into the supply reservoir of said pump. A third orifice is arranged in an intermediate position relative to the first and second orifice of each hydraulic pump cylinder, and is positioned just downstream of the piston when it is reaches the limit position near the respective first orifice of the respective cylinder. The third orifices are connected respectively with one of the orifices for the supply of the fluid into or for the discharge of fluid from the fluid pressure piston cylinders. From the pipe interlocking the first orifices of said hydraulic distribution piston pumps there is a branch pipe directly connected to the fluid reservoir.

1 Claim, 4 Drawing Figures

FLUID DISTRIBUTOR DEVICE FOR CONTROLLING AN APPARATUS FOR PUMPING WET CONCRETE AND THE LIKE

This application is a continuation-in-part of my prior U.S. patent application Ser. No. 523,017 filed Nov. 12, 1974, now U.S. Pat. No. 3,994,627.

The present invention relates to a hydraulic control device for controlling apparatus for pumping wet concrete and the like.

U.S. Pat. No. 3,994,627 relates to an apparatus for pumping wet concrete and the like which comprises a pair of piston pumps mounted in parallel relation and operating in phase opposition. The piston pumps each include a single-acting fluid pressure reciprocating piston and a cylinder. Each piston pump cylinder has an open end, a baffle blade valve means arranged at the open ends of said piston pump cylinders and two limit positions for controlling the charging and the discharging of wet concrete through the respective open ends of said piston pump cylinders. A pair of double-acting fluid pressure piston and cylinder pumps or jacks are connected to the wet concrete piston pumps for driving the same. A five-way fluid actuator-distributor means is coupled to said baffle blade valve means and hydraulically connected between a source of pressurized fluid and said fluid pressure piston cylinders for controlling the position of said baffle blade valve means and for supplying pressurized fluid to and discharging pressurized fluid from said fluid pressure piston cylinders. The actuator-distributor means has a first operative position for first moving said baffle valve means to one of said two limit positions and for subsequently supplying pressurized fluid to a first one of said fluid pressure piston cylinders and discharging pressurized fluid from a second one of said fluid pressure piston cylinders, and a second operative position for first moving said baffle valve means to the other of said two limit positions and subsequently supplying pressurized fluid to said second fluid pressure piston cylinder and discharging pressurized fluid from said first fluid pressure piston cylinder. A changeover valve means is connected to said actuator-distributor means for shifting the latter between the first and second operative positions thereof. Also provided are means for hydraulically interlocking the movements of the pistons of said fluid pressure piston cylinders and means for restoring pressurized fluid in said hydraulic interlocking means and discharging therefrom excess pressurized fluid for maintaining said fluid pressure piston pumps, as well as the concrete piston pumps in substantially exact phase opposition.

In U.S. Pat. No. 3,994,627, the main control member for controlling the system hydraulic control circuits was constituted by a five-way actuator-distributor device.

The present invention provides a substitute for said five-way actuator-distributor device, the substituted device comprising two hydraulic pistons and cylinders each provided with three orifices which operate in phase opposition and which have mechanically interlocked movements. Said device occupies a very small space as compared with the five-way actuator-distributor device and is a more simple and, reliable and responsive control device.

The accompanying drawings show, merely by way of example, an embodiment of the device of the invention applied to the pumping unit; in said drawings.

The parts which have the same function as in U.S. Pat. No. 3,994,627 have been indicated by the same reference numbers.

Figure 1:
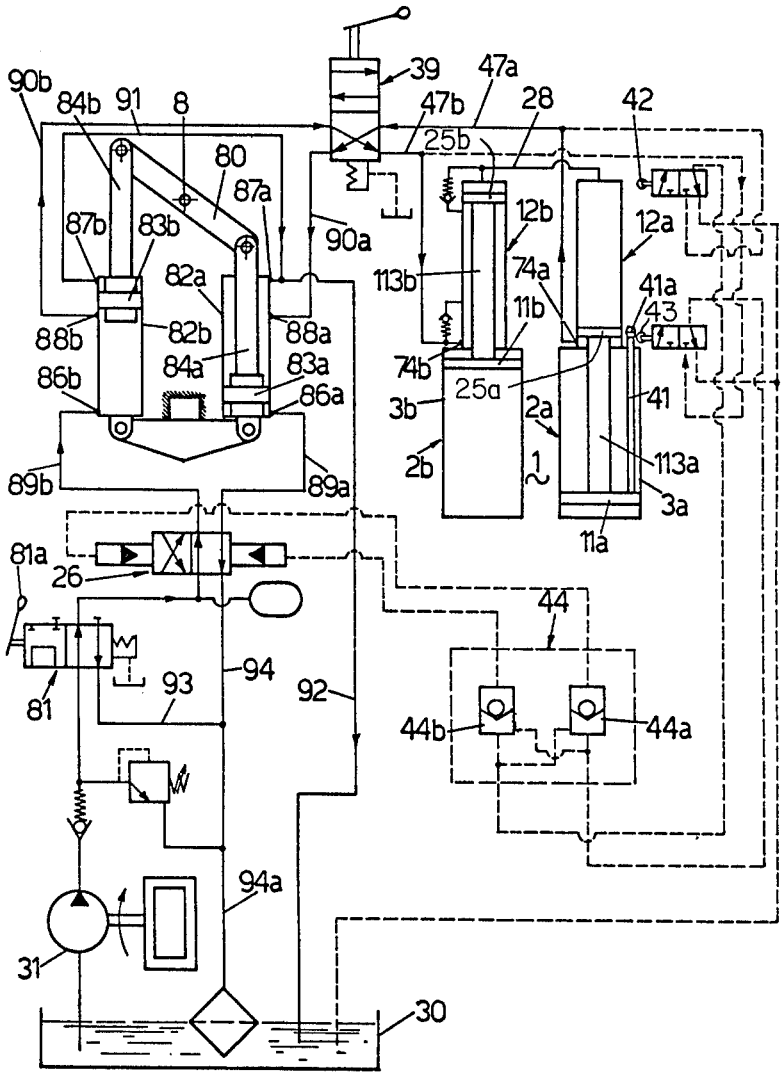
FIGS. 1 and 2 show diagrammatically the hydraulic circuits for the control of the pumping unit in two different operative positions of its parts, the pumping unit being only partly illustrated.
Figure 2:
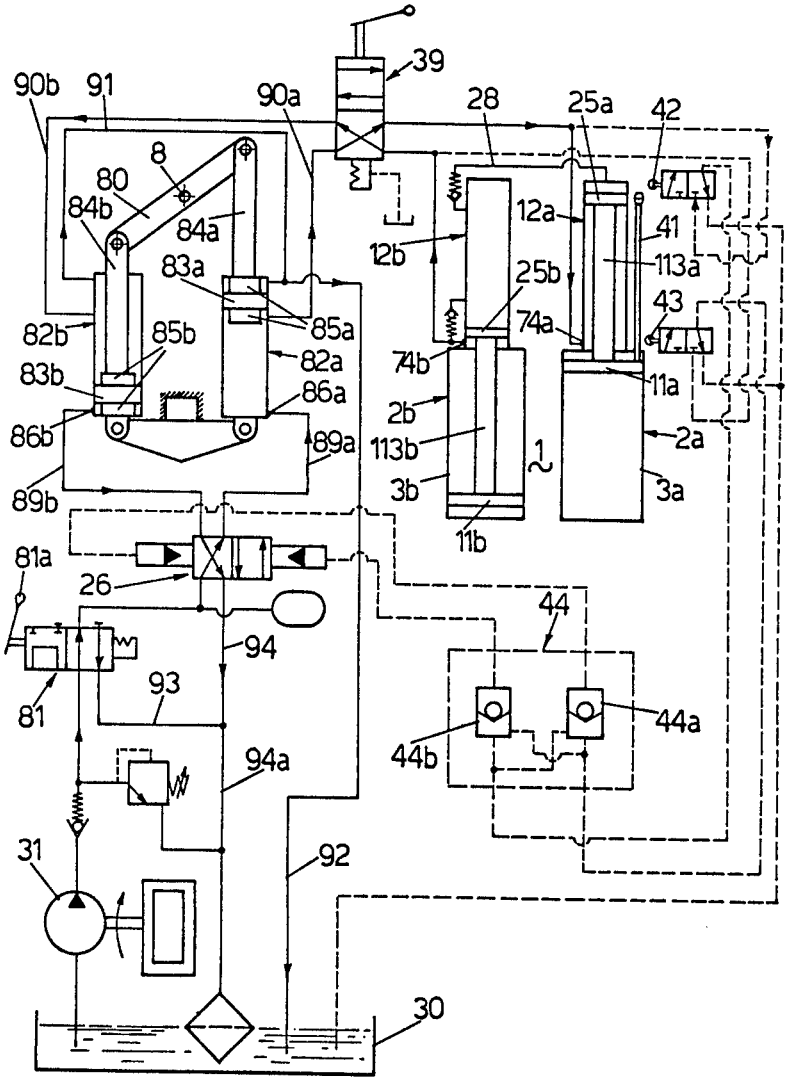
Figure 3:
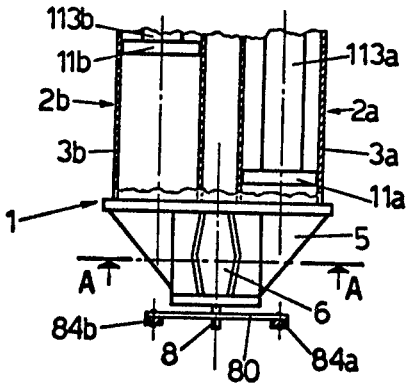
FIG. 3 is a broken front view, partly in section, of the pumping unit with the valve body connected thereto.
Figure 4:
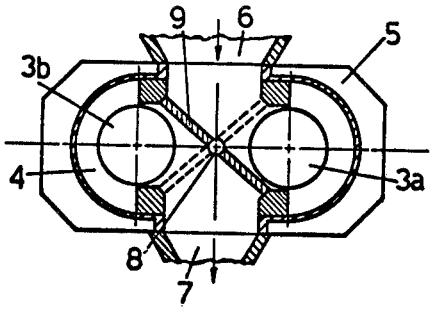
FIG. 4 is a cross-section of the valve body taken along the line A—A of FIG. 3.

The pumping unit generally marked 1, comprises two single-acting piston pumps 2*a* communication 2*b* having parallel axes, the cylinders 3*a* and 3*b* of which at one of their ends (the lower ends as seen in FIGS. 1 and 2) communicate with a chamber 4 arranged in a valve casing 5 (FIGS. 3 and 4) having a supply conduit 6 and a delivery conduit 7. In the chamber 4, there is mounted a baffle blade valve 9 which is swingable about the axis of a spindle 8 and which comprises a reciprocating baffle blade 9 or the like having two limit operative positions. In one operative position, the baffle blade valve is disposed as shown in solid lines in FIG. 3 and in the other operative position is disposed as shown in dashed lines in FIG. 3. In the first of said operative limit positions, said valve 9 places the cylinder 3*a* in communicatin with the concrete supply conduit 6 and the cylinder 3*b* in communication with the concrete delivery conduit 7. In the other limit position of the valve 9, the communication between the cylinders 3*a*, 3*b* and conduit 6, 7 is reversed. According to the present invention the spindle 8 of said baffle blade valve is made integral with the pivot pin of a rocking bar 80 which is a part of the actuator and distributor device of this invention and which will be hereinbelow described in more detail. At 12 *a* and 12*b* are indicated two double-acting fluid pressure cylinders designed to reciprocate the pistons 11*a* and 11*b* respectively of the piston pumps 2*a*, 2*b*, said pistons 11*a*, 11*b* being made integral with the respective coaxial pistons 25*a*, 25*b* (FIG. 2) through common piston rods 113*a* and 113*b*. A reversing changeover electrovalve 26 reverses the direction of fluid flow in the hydraulic circuit. A manually controlled deviation valve 39 enables the pumping unit to be shifted by a half cycle so that, during the intake phase, the pump 2*b* will be put in communication with the delivery conduit, and at the same time the pump 2*a*, performing the compression stroke, ejects the material previously sucked from the conduit 7 during the preceding half cycle into the supply conduit 6 for cleaning purposes. Pump 31 sucks the fluid from the reservoir 30 and supplies pressurized control fluid, oil for instance, to the circuit. Limit switches 42 and 43 (FIG. 2) control the reversal of the changeover electrovalve 26.

All the above-described means and devices and the other elements of the prior system which have not been particularly described remain unchanged, so that reference is made to the description thereof in U.S. Pat. No. 3,994,627, the disclosure of which is hereby incorporated by reference; if it is designed to know their respective functions and correlations. According to the present invention, the five-way actuator-distributor device of the pumping unit of the aforesaid prior patent has been now replaced by a device comprising two hydraulic cylinders particularly modified and interlocked one with the other and appropriately connected to the various hydraulic circuits. The device which is the object of this invention comprises two cylinders generally indicated 82a and 82b, having closed ends, the pistons 83a and 83b of which are connected through their piston rods 84a and 84b to the ends of a rocking bar 80 made integral with the pivot spindle 8 of the baffle blade valve. Two pair of inserted spacing rings 85a and 85b of a predetermined thickness avoid the possibility that the pistons 83a, 83b at their limit positions can come into contact with the respective heads, but, on the contrary, in each of said two positions, respectively define an annular chamber between the confronting faces of said piston and cylinder and the circumferential walls of the ring and cylinder. The orifices 86a, 87a, and 86b, 87b open into a respective annular chamber of the cylinders 82a and 82b.

Ths piston rods 84a and 84b pass through the respective upper heads of the cylinders 82a and 82b in a fluid-tight manner (according to the position of the pumping unit shown in FIGS. 1 and 2). In addition, beneath the respective pistons 83a, 83b when placed at their upper limit positions a third pair of orifices 88a, 88b respectively are arranged through the side wall of the respective cylinder. Pipes 89a, 89b respectively connect the orifices 86a and 86b to the changeover electrovalve 26, while pipes 90a, 90b connect the orifices 88a, 88b respectively to the deviation valve 39. The pipe 91 connects the first orifices 87a, 87b one with the other, from said pipe 91, a discharge pipe 92 being branched off and ending in the tank or reservoir 30. The pipe 93 serves for recycling the liquid, when the valve 81, which can be manually actuated by the lever 81a, is reversed so as to stop the supply of the pressurized fluid in the hydraulic circuit when the work is stopped, while 94 and 94a are sections of the pipe designed to return the fluid from the changeover valve 26 to the reservoir or tank 30.

FIG. 1 shows the positions of the component parts just before the end of the suction stroke of the concrete into the cylinder of pump 2b, which through the baffle blade valve 9 is in communication with the concrete supply conduit 6, while the piston 11a is near the end of its compression stroke and the cylinder of pump 2a is in communication with the concrete delivery pipe 7. The piston 11b during this stroke is actuated by the pressurized fluid, in particular oil, supplied by the pump 31 and passing through the valve 81, the electrovalve 26, (which is in the position shown in FIG. 1), and the pipe 89b entering the cylinder 82b through the orifice 86b; said fluid can be discharged only after the piston 83b has passed beyond the orifice 88b which is therefore opened. In the case wherein the baffle blade valve, controlling the supply of the wet concrete into and the delivery from the cylinders of the piston pumps 2a and 2b of the pumping unit 1, cannot attain one of its limit positions, because, for instance, its seat is partially obstructed by foreign matter, the pumping unit cannot operate, on account of the fact that the orifice 88b cannot be opened.

When the orifice 88b is opened, the pressurized fluid passes into the pipe 90b, the valve 39, which remains in the position shown in the drawings, and through the pipe 47b entering the orifice 74b, thus causing the piston 25b to be raised together with the piston 11b of the pump 2b. At the same time, from orifice 74a fluid is discharged, which passes through the pipe 47a, the valve 39 and the pipe 90a reaching the orifice 88a and entering the cylinder 82a, from which the fluid flows out through the orifice 87a, returning to the reservoir 30 through the pipe 92. Contemporaneously, the orifice 86a now acts as discharge or outlet orifice of the fluid from the cylinder 82a, since it is now connected through the pipe 89a to the electrovalve 26, from which the fluid passes through the two pipe sections 94, 94a into the reservoir 30. When the piston 11a attains the lower limit end of its compression stroke, the piston rod 41, parallel to the rod 113a actuates the switch 43 by means of its free end 41a, as disclosed in the aforesaid prior U.S. patent and causes the electrovalve 26 to changeover so that the direction of the flow of the fluid in the hydraulic circuits will become that shown in FIG. 2.

In the event that the pumping unit has to be stopped, the manual control lever 81a will be actuated, which shifts the valve 81 in its second limit position in which the fluid is recycled into the tank or reservoir 30 through the pipes 93 and 94a.

What we claim is:

1. In an apparatus for pumping wet concrete and the like comprising a pair of piston pumps mounted in parallel relation and operating in phase opposition, said piston pumps each having a reciprocating pump piston and a pump cylinder, each pump cylinder having an open end, a baffle blade valve means arranged at the open ends of said pump cylinders and having two limit positions for controlling the charging and discharging of wet concrete through respective open ends of said pump cylinders, a double-acting fluid pressure piston and cylinder arranged coaxially with each piston pump for driving said piston pumps, a common piston rod for mounting the pistons of the associated piston pump and double-acting fluid pressure piston and cylinder, a source of pressurized fluid, a fluid actuator-distributor means coupled to said baffle blade valve means and hydraulically connected between said source of pressurized fluid and said fluid pressure cylinders for controlling the position of said baffle blade valve means and for supplying pressurized fluid to and discharging pressurized fluid from said fluid pressure cylinders, said actuator-distributor means having a first operative position for first moving said baffle blade valve means to one of said two limit positions and for subsequently supplying pressurized fluid to a first one of said fluid pressure cylinders on one side of the piston associated therewith and discharging pressurized fluid from a second one of said fluid pressure cylinders and a second operative position for first moving said baffle blade valve means to the other of said two limit positions and subsequently supplying pressurized fluid to said second fluid pressure cylinder on one side of the piston associated therewith and discharging pressurized fluid from said first fluid pressure cylinder, changeover valve means connected to said actuator-distributor means for shifting said actuator-distributor means between the first and second operative positions thereof, and conduit means connected between said first and second fluid pressure cylinders on the other sides of the pistons associated therewith for hydraulically interlocking the movements of the pistons of said fluid pressure cylinders, the improvement comprising said actuator-distributor means comprising two fluid pressure pistons and cylinders operating in phase opposition, said baffle blade valve means having a spindle about which said baffle blade valve means pivots between said two limit positions, a rocking bar having ends and fixedly connected to said spindle intermediate the ends of said bar, the pistons of the actuator-distributor means each having a piston rod connected to a respective end of said rocking bar, each fluid pressure cylinder of said actuator-distributor means having closed ends and communicating with three orifices comprising a first orifice positioned adjacent one of said closed ends, the first orifices being connected by a pipe, a second orifice positioned adjacent the other of said closed ends, the second orifices being connected to one side of said changeover valve means, the other side of said changeover valve means being connected to said pressurized fluid source and a fluid reservoir and a third orifice positioned intermediate said first and second orifice such that fluid communication is established between the second and third orifice when the associated piston of the actuator-distributor means is positioned adjacent the first orifice, a respective third orifice being connected to a respective one of said first and second fluid pressure cylinders of said piston pumps for the supply and discharge of pressurized fluid thereto, said pipe connecting said first orifices being connected with said fluid reservoir.

* * * * *